US007491665B2

(12) United States Patent
Nangla

(10) Patent No.: US 7,491,665 B2
(45) Date of Patent: Feb. 17, 2009

(54) METHOD OF MAKING A TEXTILE MATERIAL AND TEXTILE MATERIAL MADE THEREBY

(76) Inventor: Kiren Nangla, 5 Grove Lane, Headingley, Leeds, LS6 4AB (GB)

( * ) Notice: Subject to any disclaimer, the term of this patent is extended or adjusted under 35 U.S.C. 154(b) by 224 days.

(21) Appl. No.: 10/518,113

(22) PCT Filed: Jun. 11, 2003

(86) PCT No.: PCT/GB03/02519

§ 371 (c)(1),
(2), (4) Date: Aug. 16, 2005

(87) PCT Pub. No.: WO03/106763

PCT Pub. Date: Dec. 24, 2003

(65) Prior Publication Data

US 2006/0063449 A1 Mar. 23, 2006

(30) Foreign Application Priority Data

Jun. 13, 2002 (GB) ..... 0213563.0
Mar. 18, 2003 (GB) ..... 0306134.8

(51) Int. Cl.

| | |
|---|---|
| ***B32B 3/00*** | (2006.01) |
| ***D03D 15/00*** | (2006.01) |
| ***D03D 15/08*** | (2006.01) |
| ***D03D 17/00*** | (2006.01) |

(52) U.S. Cl. ..... 442/304; 442/59; 442/182; 442/228; 442/232; 442/316

(58) Field of Classification Search ..... 442/230–234, 442/317, 377–379

See application file for complete search history.

(56) References Cited

U.S. PATENT DOCUMENTS

| | | | |
|---|---|---|---|
| 2,825,117 A | 3/1958 | Evans et al. | |
| 5,656,355 A | 8/1997 | Cohen | |

FOREIGN PATENT DOCUMENTS

| | | | |
|---|---|---|---|
| DE | 3341028 | | 5/1985 |
| EP | 0 304 351 | * | 2/1989 |
| EP | 0304351 | | 2/1989 |
| JP | 10102387 | | 4/1998 |
| WO | PCT/GB/0302519 | | 10/2003 |
| WO | PCT/GB03/02519 | | 9/2004 |

* cited by examiner

*Primary Examiner*—D. Lawrence Tarazano
*Assistant Examiner*—Matthew D Matzek
(74) *Attorney, Agent, or Firm*—Gable Gotwals

(57) ABSTRACT

A textile material is provided, the appearance of which can be changed by stretching a whole or a part of the material in one or more pre-determined directions. The textile material is formed using a base fabric onto which one or more coating layers (e.g. metallic coating) are applied. The coated fabric is then stretched in a substantially transverse direction to the fabric and then in a substantially longitudinal direction to the fabric.

14 Claims, 1 Drawing Sheet

METHOD OF MAKING A TEXTILE MATERIAL AND TEXTILE MATERIAL MADE THEREBY

FIELD OF THE INVENTION

This invention relates to a method of making a textile material, and to a textile material made thereby.

BACKGROUND TO THE INVENTION

Many types of textile materials are known and such materials can be formed for example, by weaving threads together to form a woven textile material or by knitting threads together to form a knitted textile material. Knitted fabrics or material are typically referred to as weft-knitted fabrics in which the threads follow a path generally transversely or across the width of the fabric, or warp-knitted fabrics in which a number of warp threads follow a path which is generally longitudinal or along the length of the fabric. However, knitted and woven fabrics include warp and weft threads therein.

Further examples of known textile materials include those which are made up of threads which exhibit different colours when viewed from differing angles, so that a textile can appear blue when viewed from one angle, and green when viewed from another, for example. In addition, metallic lame textiles are known, in which a metallic foil is coated or printed onto the surface of a base fabric.

A common feature of all the abovementioned conventional textiles is that they provide a substantially uniform pre-determined appearance. As such, conventional textile materials are of only limited use.

It is an object of the present invention to provide a textile material and method of manufacture of a textile material in which the appearance of the material can be changed and/or determined by a user.

STATEMENT OF THE INVENTION

In accordance with a first aspect of the present invention there is provided a textile material, the appearance of said textile material capable of being changed by stretching a whole or a part of the material in one or more pre-determined directions.

Thus, the user typically can manipulate a whole or part of the material to change the appearance of the same. This allows a large number of aesthetic effects to be created in the material, thereby providing a greater level of interest to a person viewing the material and making the material more versatile.

The change in appearance of the material is typically achieved by stretching the material in a direction parallel to the warp and/or weft of the material and/or in a direction transversally to the warp and/or weft of the material.

In one embodiment the change in aesthetic appearance of the material following stretching is reversible, so that returning the material to its original form returns it substantially to its original appearance.

Preferably the textile material include at least a base fabric and one or more coating layers. The one or more coating layers are typically a different colour, different texture and/or a different appearance compared to the base fabric. Thus, the contrasting appearance of the coating layer or layers to said base fabric allow the appearance of the textile material to be changed.

Preferably, the base fabric is a standard warp or weft knitted fabric or a woven fabric and further preferably said base fabric has a 28 gauge thickness. Preferably also, the base fabric is made from texturised polyester or some other 100% synthetic material.

Typically, the one or more coating layers include a foil, and preferably the coating layer(s) is a metallic foil.

In one embodiment the foil can be provided with a matt or dull outer surface, thereby providing the material with a matt aesthetic appearance. In a further embodiment the foil can be provided with a metallic or shiny outer surface, thereby providing the material with a shiny aesthetic appearance.

Preferably the appearance of the fabric is changed by stretching the material either in a direction parallel to the warp of the fabric and/or transversely of the warp of the fabric.

According to a further aspect of the present invention, there is provided a method of making a textile material, said method including the steps of selecting a base fabric, applying one or more coating layers to at least a part of a side of the base fabric, and manipulating a whole or part of the coated fabric in order to alter the structure of the coated fabric.

Preferably manipulation of the coated fabric includes the steps of stretching the fabric in a direction transversally and/or longitudinally of the fabric.

Further preferably the coated fabric is stretched initially in a direction transversally of the fabric and then in a direction longitudinally of the fabric. Stretching in the transverse direction typically results in a tension force being applied substantially at right angles to the warp of the fabric. Stretching in the longitudinal direction typically results in a tension force being applied substantially at right angles to the weft of the fabric.

Preferably the coating is secured to the fabric or rather to parts of the threads thereof, by way of an adhesive which has previously been applied thereto. A suitable procedure for applying the coating is the "Metatran"™ system used in the production of metallic lame textile materials. Alternatively, "Transfer Coating", "Laminating procedures", screen printing method or using a "foil printing and smoking machine" or a "foil stamping machine" can be used for applying the foil coating at a required thickness to produce metallic lame textile materials. The coating can then be set onto the fabric using a heating process, such as a heat press.

Preferably, the method includes a series of successive stretching steps in the substantially transverse and longitude directions of the fabric, until the desired degree of stretching has been applied to the coated fabric. Desirably also, sections of the fabric can be stretched in both directions before other sections of the fabric have been stretched. Alternatively, substantially all of the fabric which is desired to be stretched can be stretched in sections in one direction, before being stretched in sections (perhaps different sections) in the other direction.

Preferably the stretching of the fabric should be sufficient to propagate stitch rupture or breaking. The rupture of stitches will cause the fabric to "ladder". The rupture of stitches typically occurs in the weft direction of the fabric and the laddering effect typically occurs longitudinally of the fabric. The stitch rupturing or laddering is typically as a result of the warp of the threads unlocking from the weft.

Rupture of stitches is typically obtained firstly across the weft or width of the fabric. However, it is not necessary for all the width of the fabric to ladder in order to provide the improved aesthetic effect associated with the present invention. Some areas of the fabric can remain intact (i.e. no laddering).

In one embodiment the width of the fabric is increased approximately by one third of the original width of the fabric during the stretching process. For example, in one embodiment, the width of the fabric is approximately 1.5 metres and extension thereof during stretching increases the width to over 2 metres.

Preferably the force required to be applied to the weft of the material during stretching is at least 7 Newtons, and further preferably the force is 7.8 Newtons. This equates to commencement of rupture of the stitching at about 70-71% of extension of the material.

Preferably stretching the fabric in a first direction provides the material with a shiny and metallic appearance. Stretching in one or more further directions, and preferably a direction substantially at right angles to said first direction, typically provides the material with a matt, dark and/or soft appearance. The first direction is typically in a transverse direction to the fabric.

The material can be stretched manually, by Stenter Machine ™ and/or the like. The Stenter machine typically includes one or more pins or jaws which grip the fabric at the salvage of either side (the sides parallel to the warp). Separation of the pins or jaws results in the application of force on the material to extend the same to result in and propagate stitch rupture.

There is also provided a textile material made by the method as herein defined.

BRIEF DESCRIPTION OF THE DRAWINGS

The invention will now be described, by way of example, with reference to the accompanying drawings, in which.

The method according to the present invention employs the steps of choosing a warp-knitted, weft knitted or woven base fabric. In this example, the fabric is a weft-knitted fabric (one by one rub knit) made of texturised polyester and is of 28 gauge. The weft fabric includes a single yarn with interlocking loops which builds up the fabric. The threads running across the fabric are called "causes" or "warp". The threads running longitudinally of the fabric are called "wales" or "weft".

A coating is applied to the fabric using the "Metatran"™ foil transfer system. This system utilises a screen printable adhesive and a heat transfer foil, and is used for the production of mirror-finished metallic prints commonly referred to as metallic lame fabrics. There are two procedures of making a textile material using the Metatran system.

The first procedure is to apply or print the adhesive directly onto the fabric. The adhesive is then set, for example in a convection oven or a long/medium wave infra-red stove, at a temperature of 110-130° C. for 1-2 minutes. The fabric is then placed on a heat transfer press and a piece of foil is located over the area of the fabric to which the adhesive has been applied. It will be understood that the metallised underside of the foil should engage the adhesive during the transfer process. The foil is then transferred to the fabric by the application of heat at 180° C. for 15-20 seconds. The foil backing sheet is subsequently allowed to cool and is then removed.

The second procedure is to print the adhesive onto a release paper by a screen printing process. For example, a No. 43-62 monofilament screen can be used to print the adhesive onto a release paper such as TR-W28 double-sided silicone treated vegetable parchment. The adhesive is then set, for example in a convention oven or a long/medium wave infra-red stove, at 100-120° C. for 1-2 minutes. The adhesive is then transferred onto the fabric by the application of heat, at 180° C. for 10-15 seconds. The release paper is allowed to cool and is then removed. The foil is then applied to the adhesive as in the first procedure described above.

After the foil has been applied to the fabric, the method according to the invention requires the fabric to be "distressed" by stretching it firstly transversely and then longitudinally, so as to break or rupture some of the stitching of the fabric, thereby inducing "ladders" in the fabric.

Figure 1:
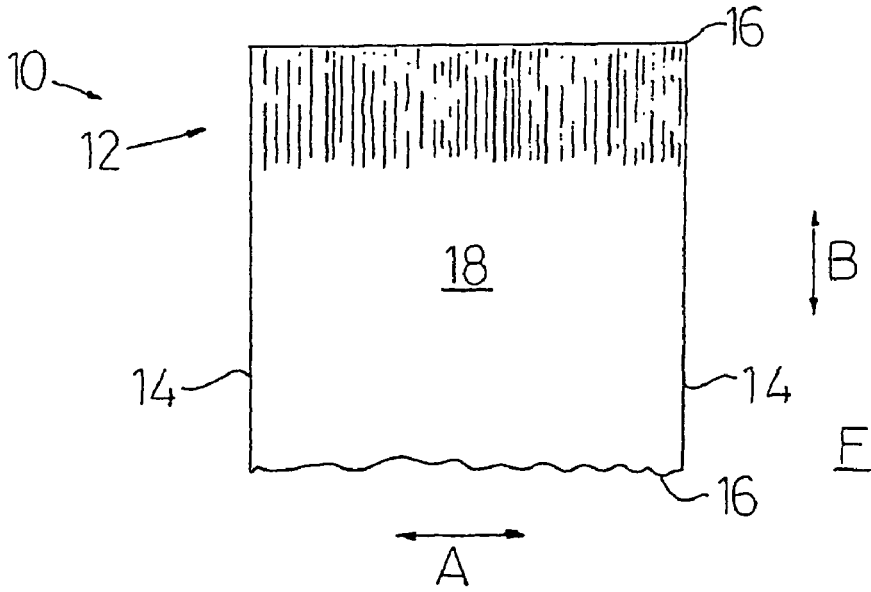
FIG. 1 is a schematic view of the textile material part-way through the method, part of the fabric having been stretched in one direction.

FIG. 1 shows a schematic view of the fabric 10, a section 12 of which has undergone stretching in the lateral direction A, which is substantially perpendicular to the longitude direction B. For simplicity, the "ladders" which have been created in the part 12 are shown, whereas the intact structure of the remainder of the fabric 10 is not shown in detail.

Sufficient stretching force must be applied to the fabric to cause the ladders to form, but excessive force which tears the fabric should be avoided. The creation of ladders is accompanied by the breaking down of the foil 18, i.e. the foil breaks into many separate pieces upon the surface of the fabric. Some trial and error may be involved in applying the correct amount of stretching force to a particular piece of fabric, but the inventor believes that this can quickly be learnt with experience.

The fabric can be stretched manually, a section at a time (where a section can be as small a part of the overall fabric as desired). Alternatively, the fabric can be stretched by machine, the machine having jaws or clamping arms which can grip the longitude edges 14 and the transverse edges 16 of the fabric, and apply a tension force thereto. The edges 14 and 16 can be gripped by the jaws at the same time, or sequentially; if gripped at the same time, the sequencing of the stretching should nevertheless be followed.

Notwithstanding that machine stretching could be used, it is envisaged that manual stretching of small sections will provide the best results, since as the fabric begins to stretch in one region it is easier manually to apply force to another region to ensure that the latter region also becomes stretched; with machine stretching it might be difficult to ensure that all of the fabric becomes substantially equally stretched, rather than just a small region becoming "over stretched" or torn.

As indicated above, the foil 18 which has been adhered to the fabric will be broken up by the distressing, i.e. the foil is bonded to parts of the individual threads of the fabric by a force greater than that holding the foil together. The foil is mostly bonded to the warp of the threads but may be bonded in some areas to the weft of the threads.

Figure 2:
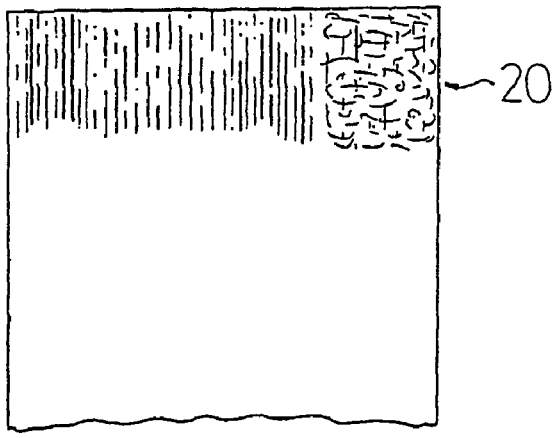
FIG. 2 is a schematic view of the textile material after part of the fabric has been stretched in the second direction.

When the section 12 of the fabric has been distressed, it is stretched in the longitudinal direction B or in the direction parallel to the warp of the fabric. Once again, in FIG. 2 only a section 20 is shown to be stretched in this way, though all of the fabric can be stretched together if desired. This stretching is undertaken again either manually by a user or mechanically by clamping longitudinal sections of the fabric in a stretching machine. The force applied in the longitudinal direction is sufficient to cause a degree of unravelling of the fabric structure (i.e. releasing the weft threads from the warp threads).

The extension force is applied to the warp of the fabric at a distance of about 10-15 cm into the fabric length, thereby pulling the warp threads away from the weft threads. This creates "unzipping" of the knit structure. This unzipping can be undertaken in sections of 15-20 cm intervals along the length of the fabric in order to achieve the best effect. Unzipping of the fabric typically takes place at about 20% extension of the fabric. It is noted that if this procedure was undertaken without applying the coating layer onto the base fabric, the fabric structure would typically fall apart. Thus, the one or more coating layers act to maintain the structure of the fabric even when stitching is ruptured. This is because the coating layer(s) bond to the fabric, and particularly the warp thread, with a force greater than that required to pull the fabric apart. The unzipping of the fabric is as a result of breaking or tearing of the coating layer(s).

The subsequent stretching in the longitudinal direction B further breaks down the structure of the fabric. It is important to note that the tension applied is not sufficient to break the threads within the fabric 10 (or at any rate only to break a few threads), but is sufficient to cause the fabric structure to be altered, and significantly to be "loosened" so that the threads become more mobile within the body of the fabric.

When the entire piece of fabric 10 has been distressed by being stretched laterally and longitudinally, a finished textile material 22 (FIG. 3) will have been created. This finished material can then be stretched transversally or longitudinally by a user to provide different aesthetic effects. The changeable aesthetic effects provided in the finished material are typically reversible.

The appearance of the finished textile material has gone from being substantially rigid, resistant to stretching and easily creasable, as is the case after the coating layer(s) is applied to the base fabric, to being resilient, soft, light weight and crease resistant once the distressing procedure has taken place.

Figure 3:
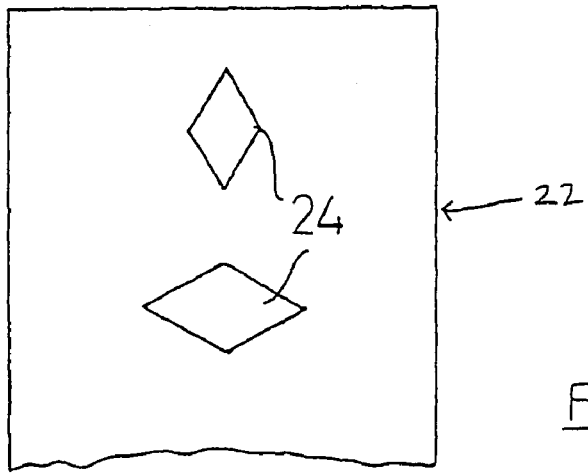
FIG. 3 is a schematic view of the finished textile material made accordingly to the method, with patterns applied thereto.

As shown in FIG. 3, it can be arranged that with experience the correct degree of distressing can be applied, and perhaps repeated distressing laterally, longitudinally, laterally, longitudinally etc., so that when the finished textile material is pulled longitudinally, the movement of the threads within the fabric is such as to take substantially all of the foil away from the surface of the material, thus causing the structure of the material to contract and shrink. In such circumstances, the foil disappears from view, and only the base fabric can be seen. In this case the material feels soft and thick to the touch and the finished appearance is typically matt. However, when a section of the material is pulled transversely, the movement of the thread is such so as to bring the foil to the surface where it is visible, thus causing the structure of the fabric to loosen and extend. The material feels light and thin to the touch relative to when the material is stretched longitudinally and the finished appearance is typically shiny and metallic.

By pulling the finished textile material laterally and longitudinally, not only can the surface pattern and texture applied to the material change colour, but the fabric length and width can also be made to increase or decrease. This has the advantage that the size of any garments made therefrom can be changed as required. Thus, the structure of the finished material as well as the surface texture can be changed according to the direction in which it is stretched.

Since the movement of the threads takes place over a relatively large area of the textile material 22, a large area can be made to change appearance from the colour of the base material to the colour of the foil, and vice versa. If the base material is black and the foil is silver, for example, startling visual patterns 24 (of silver on a black background) can be created. In FIG. 3, the sections 24 that have been pulled laterally in direction A appear silver in colour, whilst the remainder of the textile material appears black in colour.

The patterns 24 which are created can be removed simply by pulling the fabric in the longitudinal direction B. Alternatively, the pattern 24 can be altered by pulling an adjacent section of fabric transversely (increasing the amount of silver which is visible), or longitudinally (reducing the amount of silver which is visible). Natural and artificial light reflects off the fabric surface when the metallic foil is visible, in turn giving the fabric a different appearance and extra depth to the colour change.

The colour of the base fabric 10 can be selected from one of many different colours, as can the foil 16 applied thereto. However, the visual effect is greatest when there is a stark contrast between the colour of the fabric and the foil; a black base fabric and a silver metallic foil create a very good aesthetic effect.

The patterns created in the textile can be "fixed" in place by bonding the fabric to a suitable base, such as "Bondaweb"™, for example. Alternatively, the end user can stretch the finished material to create and change patterns thereon.

The visual effects which can be created are to some extent dependent upon the thickness of the base material and of the foil layer applied thereto. It has been found that a base material of 19 microns and a foil layer of 19 microns can provide reversible colour-change effects, i.e. stretching in one direction removes all of the foil from the surface so that the colour appears predominantly to be that of the base fabric, whilst stretching in the lateral direction brings much or all of the foil back to the surface so that the colour of the material appears to be that of the foil, with subsequent stretching in the two directions repeating these colour changes. However, a base material of 21 microns with a layer of 20 microns provides a non-reversible colour change, i.e. once the fabric has been stretched to create the pattern of fabric/foil colours stretching in the lateral direction will have little effect upon the pattern. Some experimentation might be necessary with varying thickness of the material and the foil layer to achieve the desired effects in a given application, noting that the thinner the base material and the foil layer the more spectacular are the colour change effects which can be created.

Incorporation of other synthetic and natural fibres into the texturised polyester base fabric before applying the foil layer thereto will result in a different feel to the end material. For example, Lycra™ can be incorporated into the warp of the base fabric to allow the material to return to its original shape following stretching. This is likely to be important for garments which are required to be fitted or figure hugging. Tactel or nylon can also be incorporated into the base fabric, by knitting or otherwise, to create different finishes and feel to the material.

One or more images and patterns can be printed or incorporated into the weave or knit of the base material and/or coating layer, thereby producing a variety of aesthetic effects. For example, images of flowers, faces and/or other colour compositions of designs in the material can be made to appear and disappear depending on the direction in which the material is stretched. Experimentation with different colours and patterns will result in different visual effects and can provide the effect of a moving image or images on the material.

Visual designs, such as flowers, could be printed on the material at different stages of its manufacture using a method, such as screen printing, computer aided printing and/or the like. An example of the different stages include:

a) a design can be printed onto the top of the foil layer or coating. The design can be applied before the layer or coating is transferred to the base fabric or after it has been located with the base fabric. The material can then be distressed or stretched in the normal manner.

b) The foil layer or coating can be provided in the form of a design or image on the base fabric prior to the material being distressed or stretched.

c) The design can be provided on the material after or during stretching or distressing of the material. This typically results in a material in which the appearance of the same can change in the normal manner but which has areas of the material to which the design relates remaining constant and non-changeable following further stretching.

The finished textile material can be used for garments, such as clothes, hosiery, sportswear or swimwear, accessories, such as headwear, footwear, bags, scarves or wraps, furnishings and interior finishes, such as blinds and upholstery. The size and the visual appearance of the material can be changed upon stretching by the user. For example, a short dress can be pulled longitudinally to become a long dress with a different aesthetic appearance. Short sleeves on a garment can be pulled longitudinally to become long sleeves with a different aesthetic appearance. Stretching of the garment in a transverse direction returns the garment to its original shape, i.e. short sleeved or short dress. If the garment is too tight and figure hugging for the user, the garment can be pulled longitudinally to become wider and longer.

Thus, no two garments will typically appear the same on two users due to the size of the user and the degree of stretching applied to the garment by the user. The user is also able to change the appearance of the garment according to their requirements and the aesthetic look they wish to create. In addition, the appearance of the garment can change during normal wearing, such as if the user is stretching or simply sitting. It can therefore be seen that the textile material of the present invention provides increased interest to a user and is more versatile than conventional textile materials.

The invention claimed is:

1. A textile material, comprising:

a base fabric having one or more threads, one or more coating layers; and, stitch rupturing and laddering of said threads, wherein an appearance of said textile is capable of being changed by stretching said material in two or more pre-determined directions;

wherein the change in appearance of said material is reversible and is returned substantially to its original appearance by stretching the material in a direction substantially at right angles to the original two or more directions of stretching.

2. A textile material according to claim 1 wherein the change in appearance of the material is achieved by stretching the material in a direction parallel to the warp and/or weft of the material and/or in a direction transversally to the warp and/or weft of the material.

3. A textile material according to claim 1 wherein the base fabric is any or any combination of a warp knitted fabric, a weft knitted fabric or a woven fabric.

4. A textile material according to claim 1 wherein the base fabric is approximately a 28 gauge fabric.

5. A textile material according to claim 1 wherein the base fabric is made from a polyester or other 100% synthetic material.

6. A textile material according to claim 1 wherein the one or more coating layers include a foil.

7. A textile material according to claim 6 wherein the foil is a metallic foil.

8. A textile material according to any preceding claim wherein stretching of the textile material in a first direction provides the material with a shiny appearance and stretching the textile material in one or more further directions provides the material with a matt appearance.

9. A textile material according to claim 1 wherein the first direction is a transverse direction to the warp of the fabric and the further direction is in a longitudinal direction of the warp of the fabric.

10. A textile material according to claim 1 wherein the material is used to form any or any combination of a garment, footwear, headwear, furnishing, upholstery or interior finishing.

11. A textile material according to claim 1 wherein a pattern, design or image is applied to the material and the appearance of the pattern, design or pattern changes on stretching of said material in said one or more pre-determined directions.

12. A textile material according to claim 1 further comprising said material having undergone at least 20% extension.

13. A textile material according to claim 1 further comprising said material having undergone at least 33% extension.

14. A textile material formed by the method comprising selecting a base fabric, applying one or more coating layers to at least a part of a side of the base fabric, and manipulating the coated fabric in two or more pre-determined directions in order to alter the structure of the coated fabric;

wherein the alteration in structure of said fabric is reversible and is returned substantially to its original structure by stretching the material in a direction substantially at right angles to the original two or more directions of manipulation.

* * * * *